United States Patent [19]

Gershenson et al.

[11] Patent Number: 4,853,030

[45] Date of Patent: Aug. 1, 1989

[54] METHOD AND APPARATUS FOR THE MANUFACTURE OF METALLIC FILAMENTS

[75] Inventors: Moshe Gershenson, Bronx, N.Y.; Thomas Schell, Wyckoff, N.J.

[73] Assignee: GAF Corporation, Wayne, N.J.

[21] Appl. No.: 181,968

[22] Filed: Apr. 15, 1988

[51] Int. Cl.[4] ..... C22B 5/20

[52] U.S. Cl. ..... 75/0.5 A; 75/0.5 AA; 266/186

[58] Field of Search ..... 75/0.5 AA, 0.5 A; 423/417, 418; 266/186

[56] References Cited

U.S. PATENT DOCUMENTS

| | | | |
|---|---|---|---|
| 2,612,440 | 9/1952 | Altmann | 75/0.5 AA |
| 2,884,319 | 4/1959 | Fabian et al. | 75/251 |
| 2,938,781 | 5/1960 | Schmeckenbecher | 75/0.5 AA |
| 3,367,767 | 2/1968 | West et al. | 75/0.5 AA |
| 3,409,281 | 11/1968 | O'Neill et al. | 266/186 |
| 3,441,408 | 4/1969 | Schladitz | 75/0.5 R |
| 3,570,829 | 2/1971 | Schladitz | 75/0.5 A |
| 3,918,955 | 11/1975 | Llewelyn | 75/0.5 AA |
| 3,943,221 | 3/1976 | Schladitz | 29/455.1 |

*Primary Examiner*—Robert McDowell

*Attorney, Agent, or Firm*—Richard T. Laughlin; Anthony Lagani, Jr.; Joshua J. Ward

[57] ABSTRACT

A method and apparatus for the manufacture of metallic filaments is provided. The method and apparatus are used in the continuous manufacture and production of metallic filaments. The apparatus comprises a vertical reactor having a vertical chamber and having three mixing nozzles disposed at the top of the chamber and three vapor lines connecting to the respective three mixing nozzles along the axes of the nozzles, and three gas lines connecting to the respective three mixing nozzles in respective tangential directions. The apparatus also has twelve ring magnets, which are coaxially disposed, and which are mounted on the outside of the vertical ractor. The apparatus also has an outlet duct at the bottom of the chamber. The three vapor lines are supplied through three respective steam-heated heat exchangers from a feed vessel for supplying iron pentacarbonyl vapor to the mixing nozzles. The three gas lines are supplied from a nitrogen receiver tank. Three secondary gas lines, which connect to the top of the reactor, are also supplied by the nitrogen receiver tank. The method of manufacture includes feeding the iron carbonyl vapor to the mixing nozzles, feeding the nitrogen to the mixing nozzles and to the top of the vessel, providing a coaxial magnetic field, and continuously carrying away a continuous supply of iron filaments.

5 Claims, 4 Drawing Sheets

METHOD AND APPARATUS FOR THE MANUFACTURE OF METALLIC FILAMENTS

The government has rights in this invention pursuant to contract number DAAK11-83-C-0047 awarded by the Department of Defense.

The invention generally relates to a method and apparatus for the manufacture of metallic filaments, and in particular, the invention relates to a continuous method and apparatus for the manufacture of metallic filaments using a vertical reactor.

BACKGROUND OF THE INVENTION

The prior art method and apparatus for the manufacture of metallic filaments is described in U.S. Pat. No. 3,441,408, issued Apr. 29, 1969. The prior art apparatus includes a horizontal reactor, which has a horizontal chamber, and which has front, rear and two side walls. The two opposite side walls have magnetic means for forming opposite north and south poles. The rear wall has an inlet opening. The front wall has an outlet opening. The reactor has a plurality of heating elements including a bank of heating pipes. The method includes feeding small quantities of carbonyls of ferromagnetic metals into an oxygen-free chamber of from $10^{-4}$ to $10^{-10}$ moles per cubic centimeter of chamber volume, and simultaneously providing a temperature gradient for thermally decomposing the carbonyl and a homogeneous magnetic field for forming chain-like aggregates. Related patents include U.S. Pat. Nos. 1,759,661, issued May 30, 1930 and 3,570,829, issued Mar. 16, 1971, and 3,943,221, issued Mar. 9, 1976.

One problem with the prior art apparatus is that it is not suitable for continuous manufacture and production of metallic filaments.

SUMMARY OF THE INVENTION

According to the present invention, an apparatus for the continuous manufacture of metallic filaments is provided. The apparatus comprises a vertical reactor having a vertical chamber and having a plurality of mixing nozzles disposed at the top of the chamber, a plurality of heat exchangers having a plurality of lines connecting to the respective mixing nozzles for feeding iron pentacarbonyl vapor thereto, a nitrogen tank having a plurality of lines connecting tangentially to the respective mixing nozzles for supplynig nitrogen thereto, a plurality of magnet rings surrounding the vertical reactor, and an outlet duct connecting to the vertical reactor at the bottom end thereof for conveying away formed chain-like aggregates.

By using the structure of a vertical reactor having mixing nozzles at the top end thereof and an outlet duct at the bottom thereof, the problem of not having a suitable apparatus for the continuous manufacture of chain-like aggregates is avoided.

The foregoing and other objects, features and advantages will be apparent from the following description of the preferred embodiment of the invention as illustrated in the accompanying drawings.

DESCRIPTION OF THE PREFERRED EMBODIMENT

Figure 1:
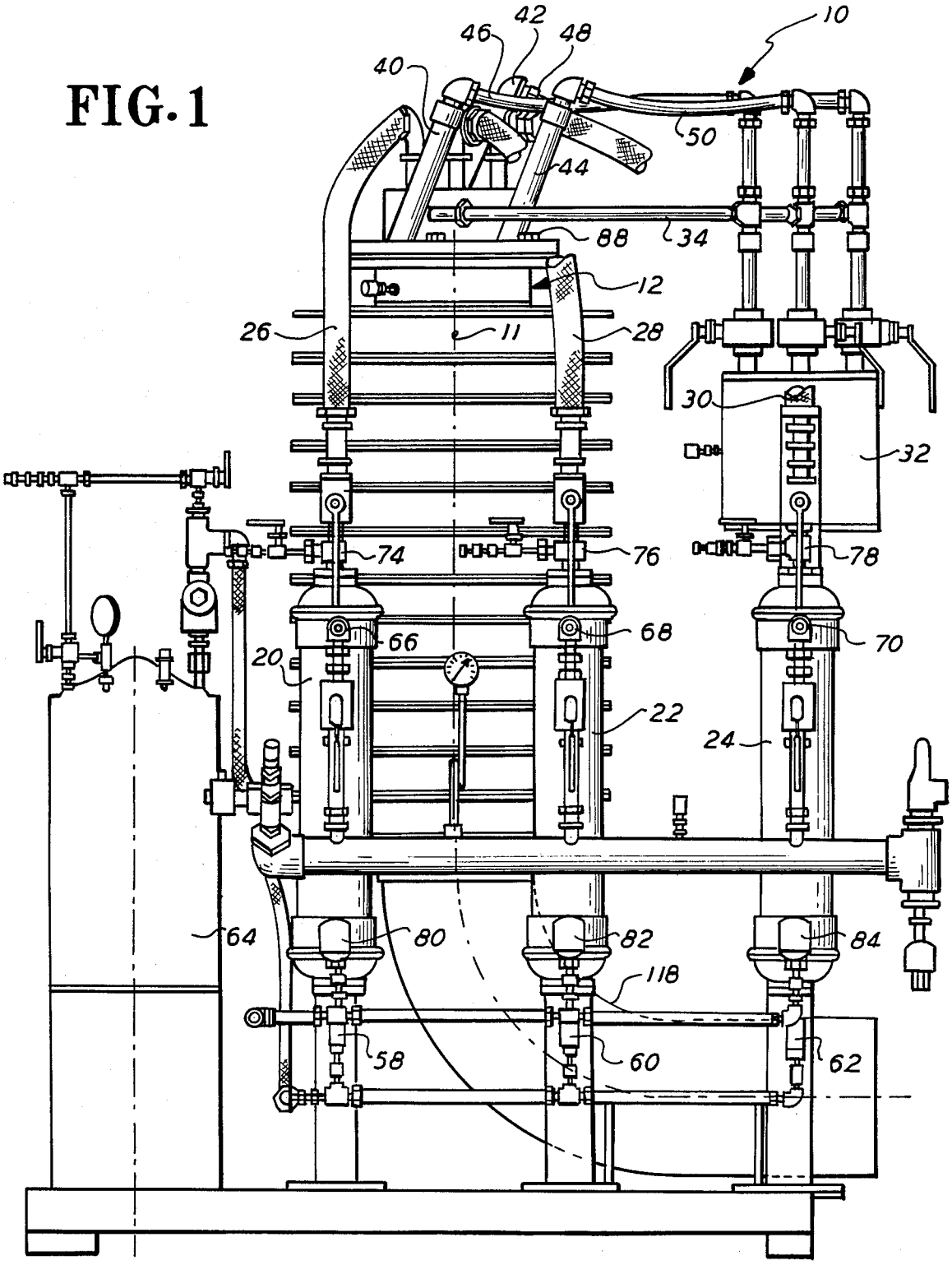
FIG. 1 is an elevation view of an apparatus according to the invention.
Figure 2:
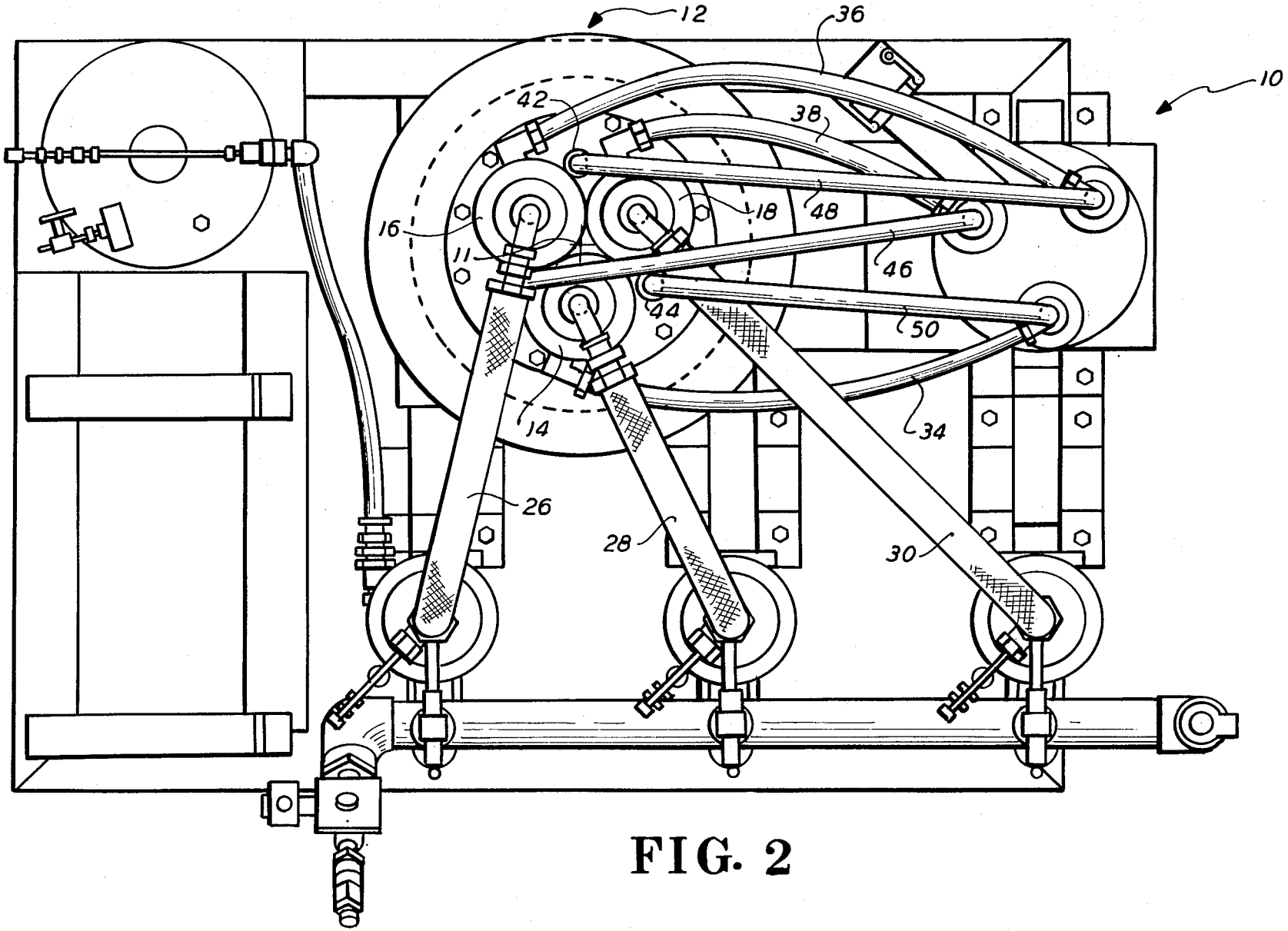
FIG. 2 is a plan view as taken at the top of FIG. 1.
Figure 3:
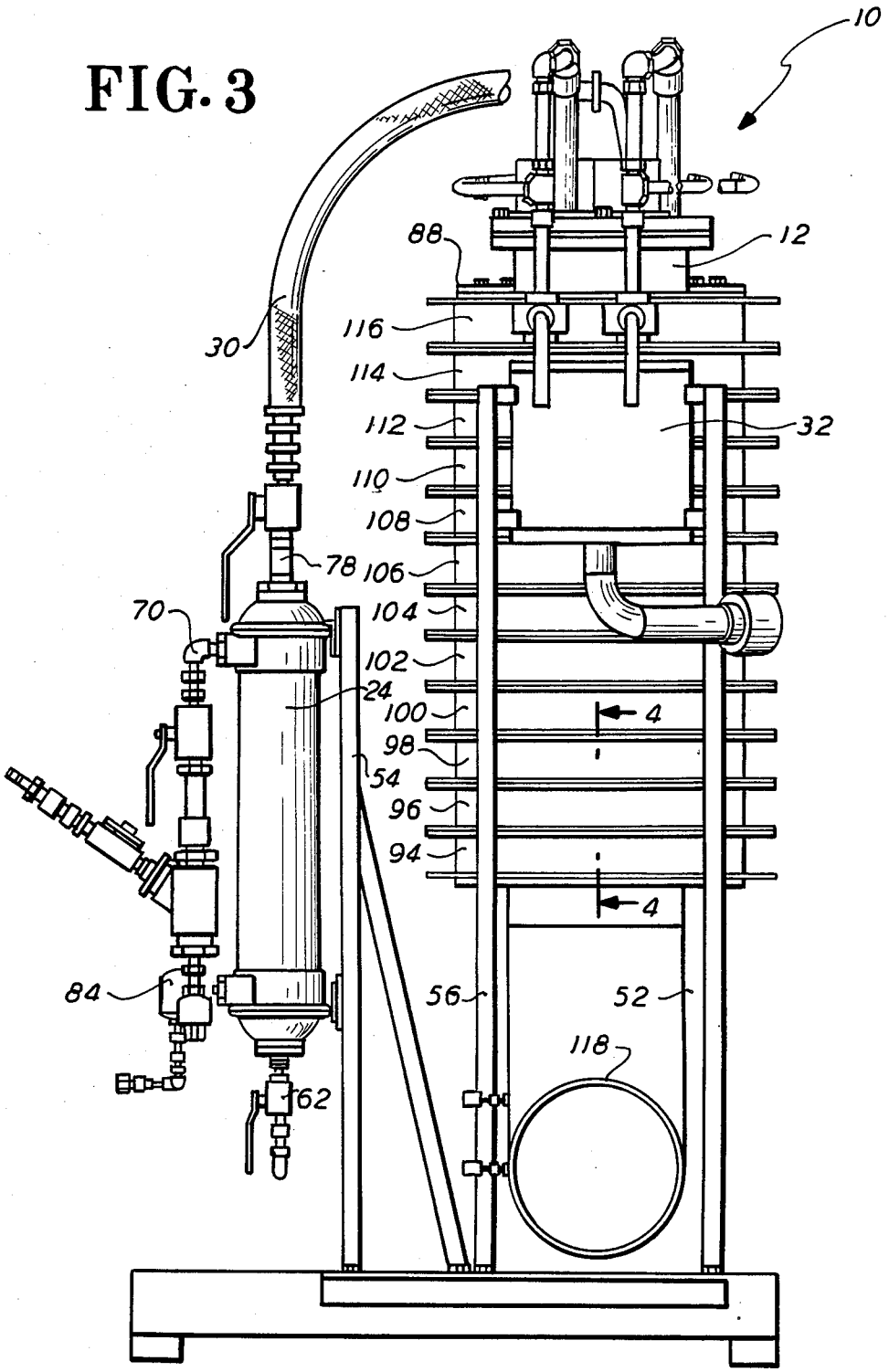
FIG. 3 is an elevation view as taken at the right side of FIG. 1.

As shown in FIGS. 1 through 4, an apparatus 10 is provided for the continuous manufacture of metallic filaments. As shown in FIG. 1, apparatus 10 includes a reactor 12, which has a vertical axis 11, and which has three mixing nozzles 14, 16, 18. Apparatus 10 also has three heat exchangers 20, 22, 24, which have respective feed discharge lines 26, 28, 30. Apparatus 10 also has a nitrogen receiver tank 32. Nozzles 14, 16, 18 have respective Tangential lines 34, 36, 38 from nitrogen receiver tank 32, Reactor 12 has three carrier gas secondary injection nozzles 40, 42, 44, which have respective lines 46, 48, 50 from tank 32. In FIG. 3, reactor 12 has a support structure 54, and tank 32 has a support structure 56, Heat exchangers 20, 22, 24 have respective feed inlet connections 58, 60, 62, which connect to a feed vessel 64. Heat exchangers 20, 22, 24 also have respective side steam inlet connections 66, 68, 70, which connect to a steam manifold 72. Heat exchangers 20, 22, 24 also have respective top vapor feed discharge connection 74, 76, 78, which connect to respective axial vapor supply line 26, 28, 30. Heat exchangers 20, 22, 24 also have respective side steam outlet connections 80, 82, 84. Iron pentacarbonyl vapor is fed through vapor feed discharge connections 74, 76, 78 and lines 26, 28, 30 to mixing nozzles 14, 16, 18.

Figure 4:
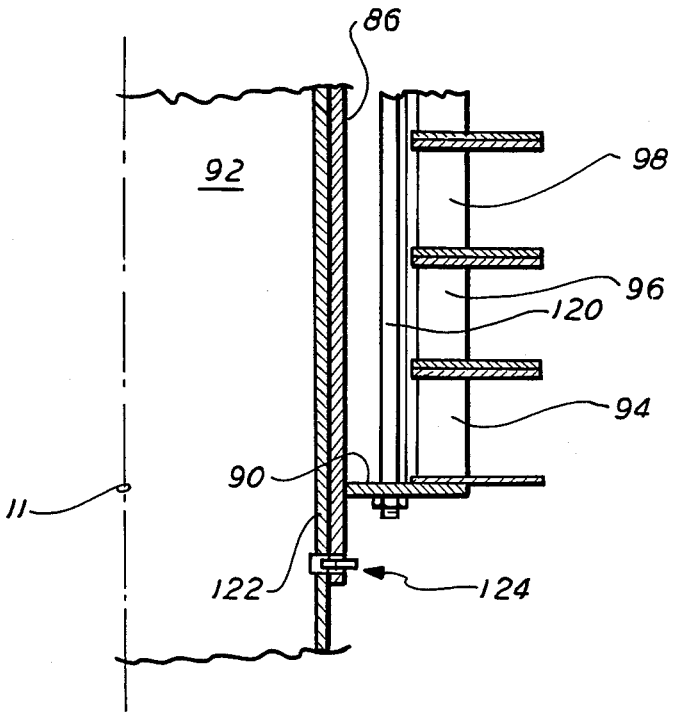
FIG. 4 is a section view as taken along the line 4—4 of FIG. 3.

In FIGS. 1 and 4, reactor 12 has a cylindrical peripheral wall 86, a top manifold or wall 88, and a bottom end wall 90. Walls 88 and 90 are axially spaces along axis 11. Walls 86, 88, 90 enclose a reaction chamber 92.

Periperal wall 86 has twelve vertically spaced magnet rings 94, 96, 98, 100, 102, 104, 106, 108, 110, 112, 114, 116, as shown in FIGS. 3 and 4, which form a magnetic field along axis 11. In FIG. 4, bottom wall 90 has a large diameter outlet duct 118 for carrying away the metallic filaments, which are formed in chamber 92. A plurality of tension rods 120 connect bottom wall 90 to top wall 88. Outlet duct 118 has a cylindrical wall 122, which is connected to peripheral wall 86 by a plurality of bolts or pins 124.

In operation, iron filaments with a diameter of approximately 0.1 microns and a length to diameter ratio of up to 1000 are produced in reactor 12. Iron pentacarbonyl ($Fe(CO)_5$) vapor is fed axially through each of the mixing nozzles 14, 16, 18. A carrier insert gas, which is nitrogen, at an elevated temperature of between 600° F. to 1000° F. is fed in a tangential direction into each of the mixing nozzles 14, 16, 18. As the vapor and the carrier gas emerge out of the outlet of each of the mixing nozzles 14, 16, 18, they mix together and the decomposition process begins. Spherical iron particles precipitate out of the vapor on their downward motion into the reactor section of the chamber 92. As the decomposition process takes place, a magnetic field of a minimum strength of 200 gauss is applied along axis 11 of reactor 12 with a plurality of magnet rings 94, 96, 98, 100, 102, 104, 106, 108, 110, 112, 114, 116. This causes the spherical particles to attach themselves to each other and orient along the lines of force of the magnetic field, forming the iron filaments as a chain of spheres.

In a prototype of this embodiment, reactor 12 is a 10-inch diameter reactor. Reactor 12 is also constructed of non-magnetic stainless steel, so that the magnetic field which surrounds reactor 12 is not shunted.

The method of manufacture includes feeding a continuous supply of iron pentacarbonyl vapor axially into a mixing nozzle disposed in the top of a chamber of a reactor, feeding a continuous supply of nitrogen gas in a tangential direction into the mixing nozzle at a gas temperature of between 600° F. and 1000° F. for mixing together the vapor and the gas; providing a magnetic field along a vertical axis of the oxygen-free chamber for forming iron filaments as a chain of spheres therein; and carrying away a continuous output of iron filaments from the bottom of the chamber.

The advantages of the method and apparatus 10 for the manufacture of metallic filaments are described hereafter.

1. By using a vertical reactor 12 having mixing nozzles 14, 16, 18 at the top of a chamber 92 of the reactor 12 and having an output duct 118 at the bottom of the chamber 92, a continuous manufacture and production of iron filaments is provided.

2. By feeding a continuous supply axially to the mixing nozzles 14, 16, 18 or iron pentacarbonyl vapor and by feeding tangentially to the mixing nozzles 14, 16, 18 a continuous supply of a carrier inert, a thorough mixture of the vapor and the gas occurs at the top of the chamber 92, whereby the iron filaments form as a chain of spheres along a coaxial magnetic field in a continuous output.

While the invention has been described in its preferred embodiment, it is to be understood that the words which have been used are words of description rather than limitation and that changes may be made within the purview of the appended claims without departing from the true scope and spirit of the invention in its broader aspects.

For example, in place of using nitrogen as the carrier inert gas, carbondioxide (CO2) or carbon monoxide (CO) can be used.

As another example, additional heat to the chamber for 92 for sustaining the endothermic reaction can be supplied through a set a electrical heating elements, which are mounted on the surface of reactor 12.

As further example, instead of three nozzles 14, 16, 18, any practical number of nozzles can be used.

As another example, apparatus 10 can produce other types of metallic filaments from carbonyls, such as cobalt carbonyls or nickel carbonyls, instead or iron carbonyls.

The embodiments of an invention, in which an exclusive property or right is claimed are defined as follows:

1. A multi-stage apparatus for the continuous manufacture of differing quantities of metallic filaments comprising:

a vertical reactor having a vertical axis of symmetry and having a top end wall and a cylindrical peripheral wall enclosing a reactor chamber;

a stack of magnet rings surrounding the cylindrical peripheral wall and supported by the reactor;

a feed vessel having first and second vapor feed lines for feeding metal carbonyl vapor;

first and second heat exchangers respectively connecting the first and second vapor feed lines;

first and second vapor supply lines respectively connecting to the first and second heat exchangers;

first and second mixing nozzles respectively connecting to the first and second vapor supply lines and connecting to the top end wall of the reactor;

a receiver tank having first and second gas lines respectively connecting to the first and second mixing valves for supplying an inert gas thereto; and an outlet duct suspended from the cylindrical peripheral wall for removing the metallic filaments from the reactor chamber.

2. The apparatus of claim 1, wherein the reactor has a bottom end wall portion supporting the stack of magnet rings and has a plurality of tension rods connecting at one end thereof to the reactor top end wall and connecting at the other end thereof to the reactor bottom end wall portion.

3. The apparatus of claim 1, wherein the reactor cylindrical peripheral wall has a plurality of shear bolts connecting to the outlet duct for suspending the outlet duct from the reactor cylindrical peripheral wall.

4. The apparatus of claim 1, wherein each of the first and second vapor supply lines and each of the first and second inert gas lines has a control valve for regulating the rate and quantity of metallic filaments produced.

5. The method of continuous manufacture of metal filaments comprising:

collecting a volume of metal carbonyl vapor in a collector;

conducting a stream of metal carbonyl vapor away from the collector;

conducting the stream of metal carbonyl vapor through a heating zone at a temperature of about 600 degrees F. to 1000 degrees F.;

conducting the heated metal carbonyl vapor stream to a mixing area;

collecting a separate volume of inert gas;

conducting a stream of the inert gas to the mixing area;

mixing the heated metal carbonyl vapor stream with the inert gas stream to form a gas mixture stream;

conducting the gas mixture stream in a vertically downward direction through a magnetic field to form a stream of elongate metal filaments;

dropping the elongate metal filament stream away from the magnetic field; and conveying away the elongate metal filament stream.

* * * * *